United States Patent [19]

Nutt

[11] Patent Number: 5,067,995

[45] Date of Patent: Nov. 26, 1991

[54] METHOD FOR ENHANCING STABILITY OF HIGH EXPLOSIVES, FOR PURPOSES OF TRANSPORT OR STORAGE, AND THE STABILIZED HIGH EXPLOSIVES

[75] Inventor: Gerald L. Nutt, Menlo Park, Calif.

[73] Assignee: The United States of America as represented by the United States Department of Energy, Washington, D.C.

[21] Appl. No.: 366,715

[22] Filed: Jun. 15, 1989

[51] Int. Cl.[5] ..... C06B 45/00

[52] U.S. Cl. ..... 149/2; 149/4; 149/9; 149/92; 149/108.8; 149/109.4; 102/290

[58] Field of Search ..... 149/2, 4, 9, 10, 87, 149/88, 92, 108.8, 109.4; 264/3.4; 102/290

[56] References Cited

U.S. PATENT DOCUMENTS

| | | | |
|---|---|---|---|
| 3,544,360 | 12/1970 | Gardner | 117/100 |
| 3,702,792 | 11/1972 | Nolte et al. | 149/10 |
| 4,097,317 | 6/1978 | Schnur et al. | 149/7 |
| 4,163,681 | 8/1979 | Rothenstein et al. | 149/11 |
| 4,363,273 | 12/1982 | Luebben et al. | 102/431 |
| 4,425,170 | 1/1984 | Jones | 149/109.6 |
| 4,430,132 | 2/1984 | Painter | 149/109.6 |
| 4,452,653 | 6/1984 | Luebben et al. | 149/11 |

*Primary Examiner*—Brooks H. Hunt
*Assistant Examiner*—Chrisman D. Carroll
*Attorney, Agent, or Firm*—Henry P. Sartorio; L. E. Carnahan; William R. Moser

[57] ABSTRACT

The stability of porous solid high explosives, for purposes of transport or storage, is enhanced by reducing the sensitivity to shock initiation of a reaction that leads to detonation. The pores of the explosive down to a certain size are filled under pressure with a stable, low melt temperature material in liquid form, and the combined material is cooled so the pore filling material solidifies. The stability can be increased to progressively higher levels by filling smaller pores. The pore filling material can be removed, at least partially, by reheating above its melt temperature and drained off so that the explosive is once more suitable for detonation.

13 Claims, 4 Drawing Sheets

METHOD FOR ENHANCING STABILITY OF HIGH EXPLOSIVES, FOR PURPOSES OF TRANSPORT OR STORAGE, AND THE STABILIZED HIGH EXPLOSIVES

The U.S. Government has rights in this invention pursuant to Contract No. W-7405-ENG-48 between the U.S. Department of Energy and the University of California for the operation of Lawrence Livermore National Laboratory.

BACKGROUND OF THE INVENTION

The invention relates generally to porous solid high explosives, and more particularly to the stabilization of porous solid high explosives.

A high explosive is a porous material, with a wide distribution of pore sizes. The pore sizes typically range from about 0.01 μm to sizes exceeding 10 μm, with a multi-mode distribution that reflects the process by which the explosive was prepared. Based upon examination of electron micrographs of undetonated explosives such as TATB and HMX, it appears that mean pore size is less than 0.1 μm, with perhaps one percent by volume of pore sizes being about 10 μm and one percent by volume being about 50 μm. These larger size pores (diameter greater than or about 10 μm) are initiation sites at shock pressures of the order of 30 Kbar. Ignition occurs in the material surrounding one of these large pores if the heat content of a hot spot (where the internal energy from a passing shock wave is locally much higher than in the adjacent material) reaches a threshold value for a runaway reaction.

Over the last eight years the theory of initiation of runaway reaction in explosive materials has centered around the existence of these pores. The current understanding is summarized in a review of explosive models: Gerald L. Nutt, "A Reactive Flow Model For a Monomolecular High Explosive", J. Appl. Phys., 64 (4) August 1988, particularly Section II.

The primary mechanism involved in the shock initiation of solid high explosives is the visco-plastic heating of the explosive material surrounding the microscopic pores left in the material during manufacture. The initiating shock causes the pores to collapse. The resulting local heating can raise the temperature to the critical value required for runaway reaction in the explosive. Whether or not the temperature reaches the critical value depends on the values of the pressure, the pore volume and the heat conductivity of the explosive material, among many other less significant parameters.

The presence of the larger pores, and the consequent instability of solid high explosives creates a danger of ignition and detonation, particularly when the explosives are transported or stored. Therefore, it would be desirable to provide a stabilized explosive, and method for making same, to reduce the danger of ignition and detonation during transport or storage. The largest pores cause the greatest instability, e.g. pores of about 10 μm diameter or greater. However, the pore size cannot generally be reduced or eliminated during the conventional manufacture of the explosives. There is no practical way to prevent the formation of some pores with diameters of about 10 μm or greater during the manufacturing process. Therefore, all conventionally manufactured explosives will contain sufficiently large pores that are susceptible to shock initiated detonation at relatively low pressures.

There have been previous efforts to desensitize solid high explosives, such as mixing an energetic, relatively sensitive, explosive with one much less sensitive and somewhat less energetic. An example is the LLNL developed RX-26-AF. This explosive was an approximately equal mixture of HMX and TATB. The hope was that the mixture would have the sensitivity of the least sensitive component of the mixture (TATB) and performance approaching the more energetic component (HMX). This attempt was unsuccessful as sensitivity to shock initiation was found to be determined by the most sensitive component of the mixture, HMX.

On the other hand, there are processes which successfully make insensitive explosives more sensitive. Some commercial slurry explosives are extremely insensitive which allows them to be safely transported through populated areas. When the explosive is emplaced, it is sensitized by mixing in tiny glass microspheres.

SUMMARY OF THE INVENTION

Accordingly it is an object of the invention to provide a method for desensitizing or stabilizing a porous solid high explosive, particularly during transport and storage.

It is also an object of the invention to provide a stabilized solid high explosive.

It is another object of the invention to make porous solid high explosives less sensitive to shock initiated ignition and detonation.

It is a further object of the invention to suppress the initiation of shock induced detonation in the larger pores of a solid high explosive.

It is also an object of this invention to provide a method of stabilizing an explosive in such a way that is is safe to a predetermined level of applied shock.

It is another object of this invention to provide a method of safely expanding the range of application of powerful explosive materials into areas where they have until now been limited by safety considerations.

The invention is both a method for stabilizing a porous solid high explosive by filling the larger pores with an inert material to increase the pressure and temperature required for detonation, and a stabilized solid high explosive with an inert material filling the larger pores. The invention suppresses the tendency for ignition to begin, in the presence of a shock and the associated elevated temperature, by forcing an inert, stable material with low melt temperature into the largest pores of the explosive, after which the temperature of the filled combination material is lowered to ambient or other suitable temperature and the pore-filling material hardens or solidifies. The stability is increased by filling down to smaller pore sizes. Suitable pore-filling materials are Ga ($T_{melt}$=31° C.), a binary eutectic of Rb and K ($T_{melt}$=33° C.), Wood's metal ($T_{melt}$=70° C.), bees wax ($T_{melt}$ about 40° C.) and various low viscosity epoxies. After the (solidified) combined material has been transported and/or stored, the pore-filling material may be drained by moderate heating of the stabilized combination and the explosive is available for conventional detonation. Alternatively, the explosive might be detonated in its still-solidified form or a partly solidified form by use of a higher strength shock with much larger associated temperature rise.

DETAILED DESCRIPTION OF THE PREFERRED EMBODIMENTS

The invention is a method for stabilizing a porous solid high explosive by substantially filling the pores above a predetermined size with a relatively inert material to lower the sensitivity to shock induced detonation. The invention also includes the stabilized solid high explosive formed by substantially filling the pores of the high explosive above a predetermined size with a relatively inert material. The smaller the pore size filled the higher the resulting stability. The method is generally reversible so that the pore filling material may be removed to recover the initial explosive material.

The larger pores, because they produce the greater amount of local heating, are the most important at threshold shock pressure. If these pores can be prevented from collapsing, the explosive can only be initiated by the next smaller size group of pores. The smaller pore sizes will require higher shock pressure in order to reach the initiation temperature for runaway reaction. Thus, the explosive will be less sensitive.

By incrementally filling the largest and then the smaller size pores, the required shock strength required to initiate runaway reaction is progressively increased and the shock sensitivity of the explosive is reduced.

FIGS. 1A-D show scanning electron micrographs of some common solid explosives (LX-17, ultrafine TATB, PBX 9404, and PETN, respectively), all at the same magnification, showing the inherent porosity which creates stability problems. The pores function as the microspheres in a slurry and increase sensitivity to detonation.

Figure 1A:
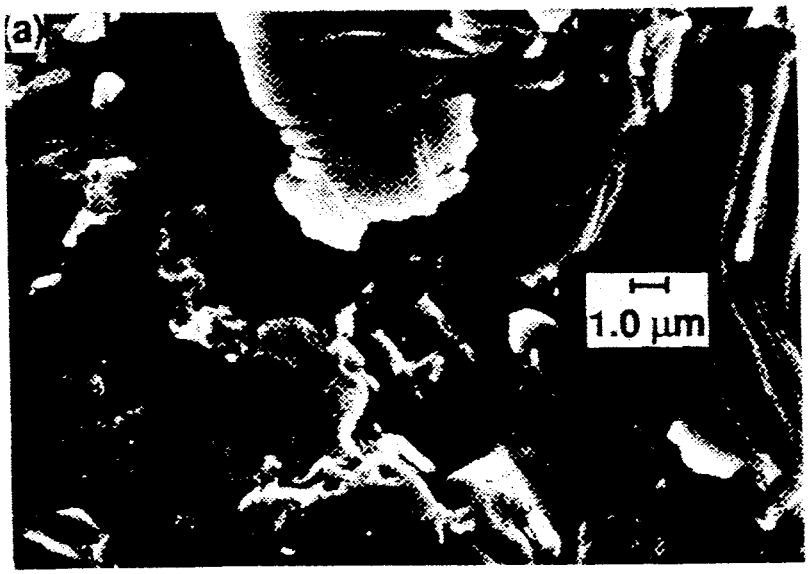
FIGS. 1A-D are scanning electron micrographs of four solid explosives showing their porosity.
Figure 1B:
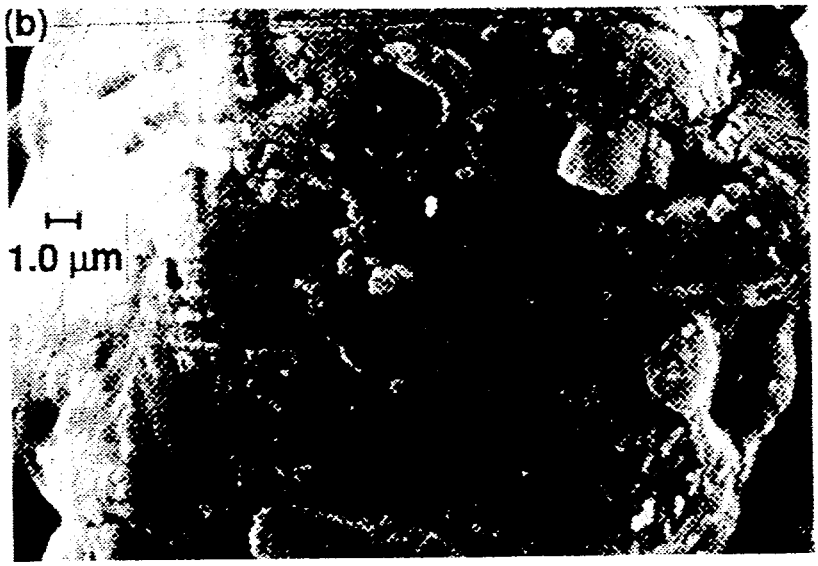
Figure 1C:
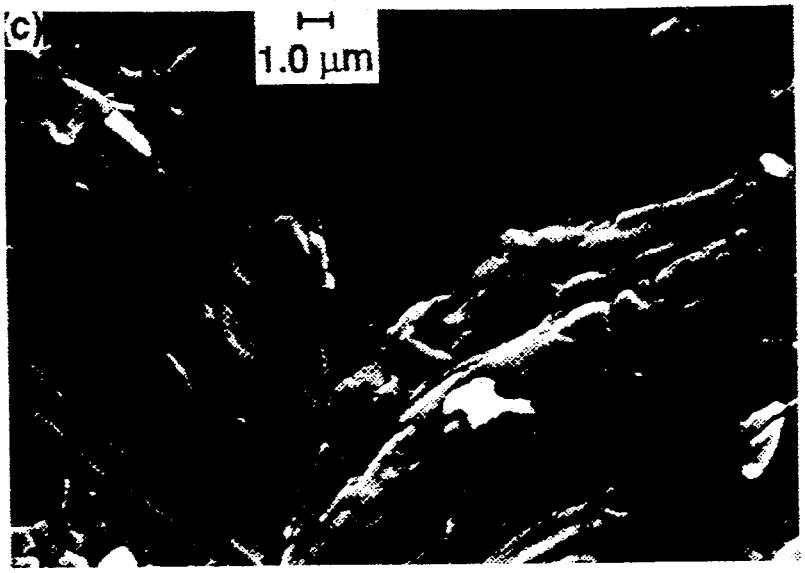
Figure 1D:
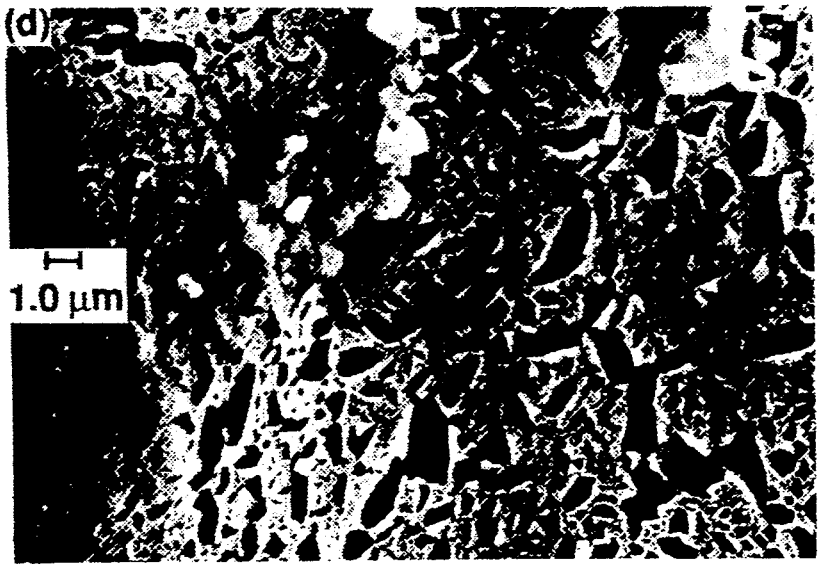
Figure 2:
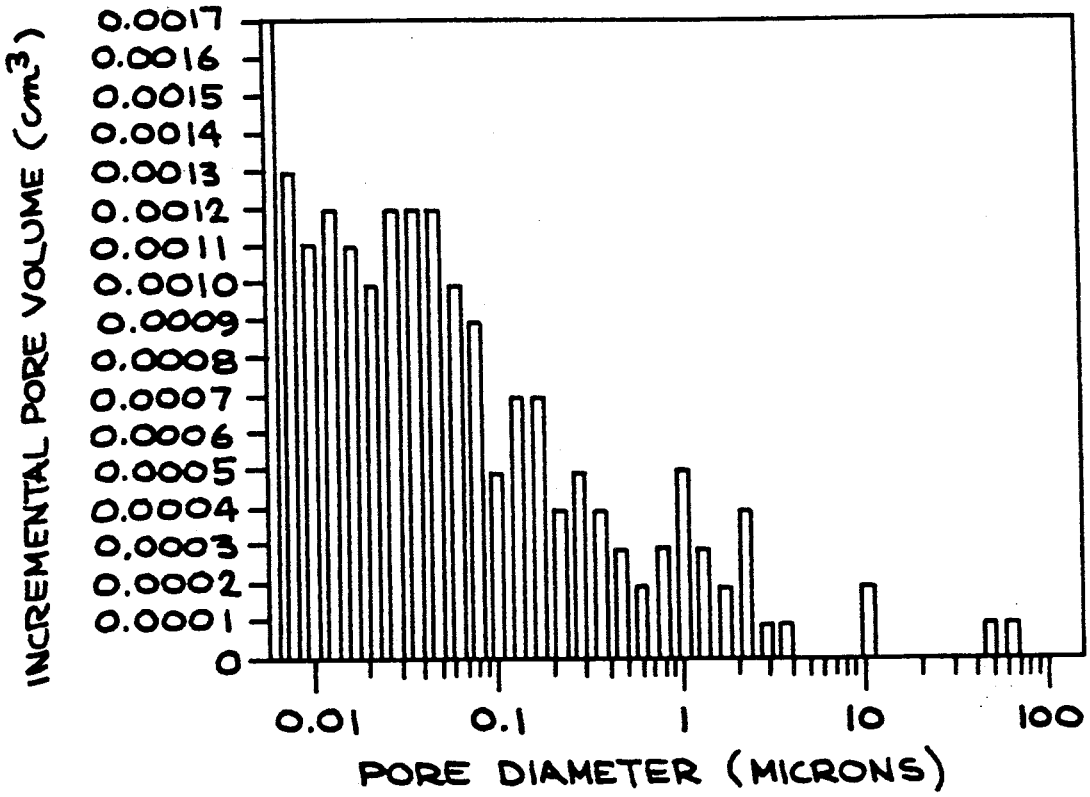
FIG. 2 is a representative distribution of pore sizes in a solid high explosive (PBX 9404).
Figure 3:
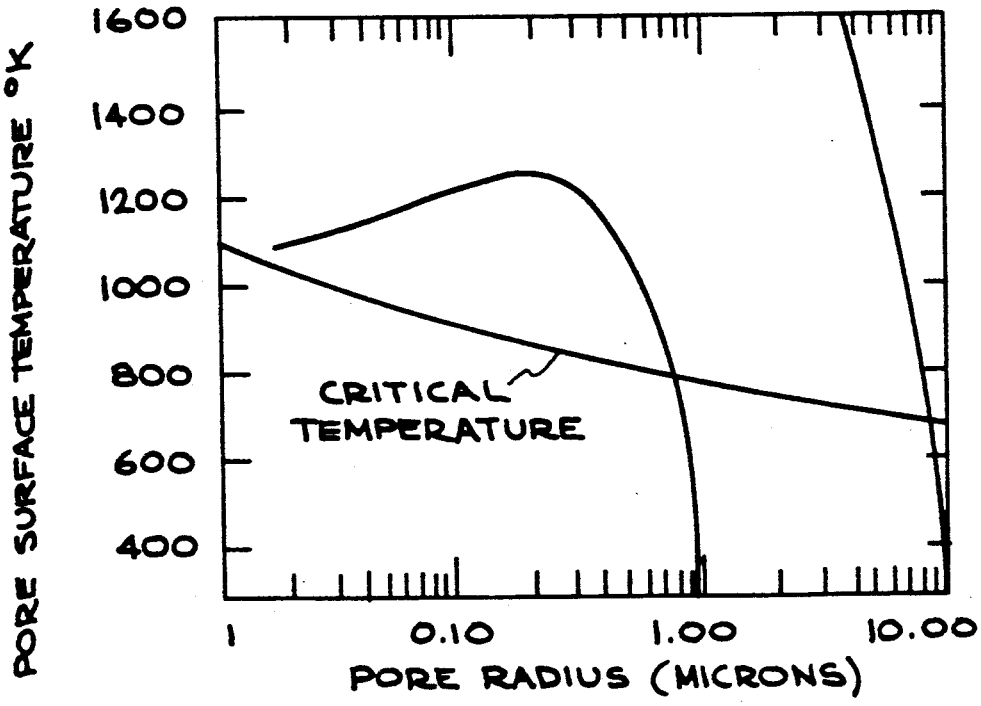
FIG. 3 is a graph of the temperature required for detonation as a function of pore size.

A typical multimode pore size distribution in a porous high explosive (PBX 9404) is shown in FIG. 2. The distribution is obtained by mercury intrusion porosimetry. Generally, most of the pores are small, less than about 0.1 μm diameter, with a mean pore diameter of 0.024 μm. About 1% of the total pore volume is composed of 10 μm size pores and an equal volume of pores occur with sizes of approximately 50 μm. However, the larger size pores, about 10 μm diameter and greater, although only making up a few volume percent of the total number of pores, are the primary cause of the shock detonation instability. The relation between critical pore size and temperature is illustrated in FIG. 3, for the explosive PBX 9404 (HMX crystals with a nitrocellulose binder) under an applied pressure of 27 Kbar. The three upwards convex curves are the pore temperatures as functions of instantaneous pore radius for initial pore sizes of 0.1, 1, and 10 μm. The threshold temperature for runaway reaction (critical temperature curve) is also plotted for comparison. Comparing the temperature history of the three sample pore sizes it is clear that those pores equal to or larger than 1 μm can reach ignition temperature while the pores of radii near 0.1 μm will not react. The temperature required for detonation of the explosive decreases for increasing pore sizes. Above about 10 μm, relatively low temperatures, and therefore relatively low shock pressures are sufficient to ignite. Below about 10 μm, the temperature and shock pressure become sufficiently high that the explosive is relatively insensitive to accidental shock detonation. In accordance with the invention, pores of a predetermined size, e.g. 10 μm, or greater are substantially filled with an inert material which prevents these pores from becoming initiation sites at relatively low shock pressures as may be accidentally applied during transport, handling and storage. The lower the pore size selected, the higher stability will be achieved.

The invention applies to any solid high explosive having large enough pores which cause an unacceptable sensitivity to shock initiation of detonation reactions. The types of explosives include cast explosives, e.g., TNT, and plastic bonded explosives, e.g., PBX 9404. Typical high explosives include: PBX 9404, which is composed of HMX (cyclotetramethylene tetranitramine) crystals with a nitrocellulose binder; TATB (trinotrobenzene triamine); LX-17, which is a pressed mixture of 92.5 wt. % TATB with a 7.5 wt. % KelF ($C_8H_2Cl_3F_{11}$ polymer) binder; PETN (pentaerithritol tetranitrate). For each explosive, pores of a predetermined size or greater may be substantially filled to produce a desired stability. The size selected is based on the degree of stability desired.

The tendency of the explosive to ignite and detonate is suppressed by substantially filling the pores of predetermined size or greater with a relatively inert, stable, pore filling material. The material should have a low melt temperature so that it is substantially solid at ambient temperature, but becomes substantially liquid or viscous at a slightly higher temperature. Metals such as gallium (Ga) with a melt temperature of 31° C. or a binary eutectic of rubidium (Rb) and potassium (K) with a melt temperature of 33° C. or an alloy such as Wood's metal (70° C.) are suitable, as well as bees wax (40° C.) or a low viscosity epoxy which can be polymerized in place.

The pores of the explosive are filled with a low melt temperature, inert, liquid material under pressure. The explosive with filled pores can then be cooled below the melt temperature of the injected inert material. The injected material will then solidify and the pressure can be removed without it draining from the explosive.

As the pressure of the liquid material is increased the material is forced, against the surface tension, into progressively smaller pores. By this pressure control technique the pores of the explosive are selectively filled. The intruded material is then held in the pores by either freezing or polymerizing it.

The procedure for desensitizing a given explosive could begin by determining the distribution of pores by standard mercury intrusion on a typical sample of the explosive. The largest pores will be filled first and as the pressure in the mercury is increased, progressively smaller pores will be filled. Noting the volume of intruded mercury at the threshold for filling pores of a given size, provides the information necessary for filling the explosive with the desensitizing material to any predetermined pore size.

The pore filling material is heated to a temperature sufficient to bring it to a liquid or viscous state, and pressurized to a predetermined pressure, to infiltrate or force the material into the pores of the explosive.

Figure 4C:
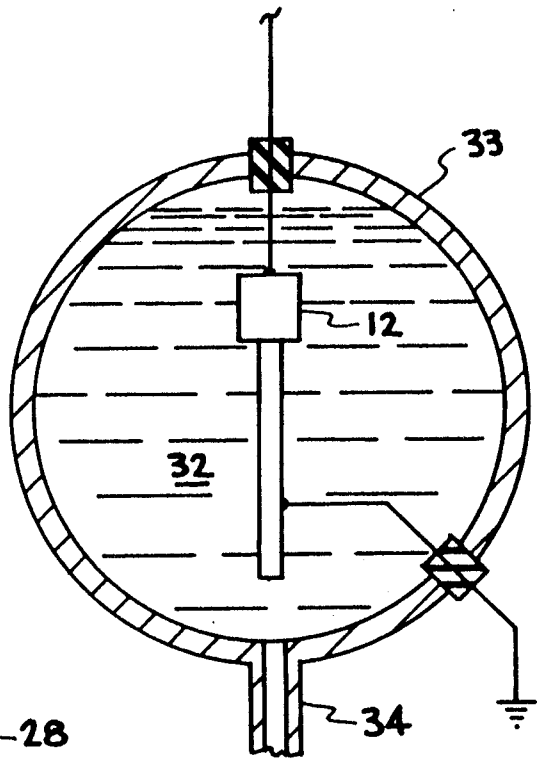
FIGS. 4A-C are sectional views of apparatus for intrusion of stabilizing inert material into porous solid explosive.
Figure 4B:
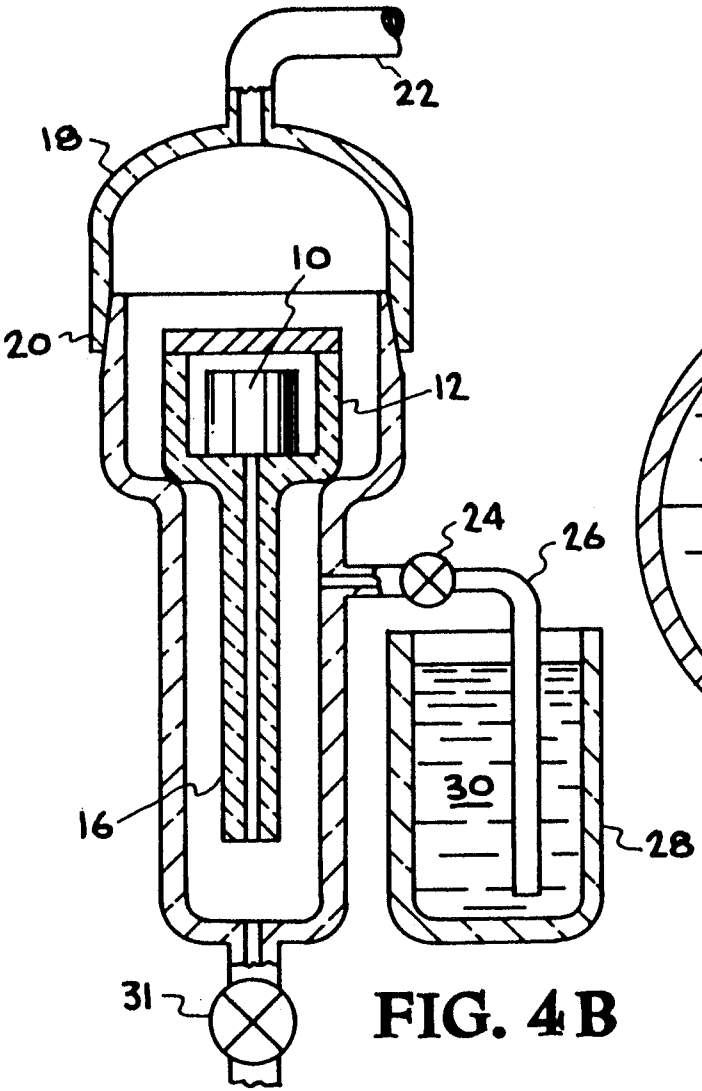
Figure 4A:
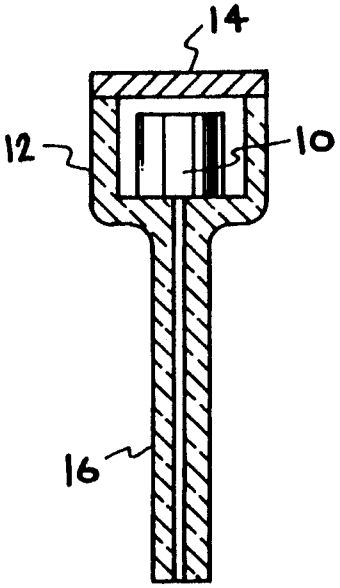

An apparatus for intruding the inert material into the porous explosive is shown in FIGS. 4A-C. The sample explosive 10 is first placed in a glass penetrometer 12 with metal cap 14 and capillary tube 16 as shown in FIG. 4A. The outer surface is either graduated or coated with metal. The penetrometer 12 is then placed in the glass container 18 shown in FIG. 4B. Glass container 18 fits together at tapered glass joint 20. A vacuum is drawn on the container 18 through vacuum port 22 until the explosive 10 is outgassed. The valve 24 in the intake line 26 to the molten penetrant container 28 is opened allowing the fluid 30 to be drawn up the capillary 16, completely filling the penetrometer 12 and covering the surface of the explosive sample 10.

While the penetrant is still molten, the penetrometer 12 is removed (by opening valve 31 and container 18) and placed in a pressure vessel 33 containing hot oil 32 as shown in FIG. 4C. The oil is heated sufficiently to keep the penetrant molten during pressurization through pressure port 34. As the pressure is raised the penetrant is forced into the explosive against surface tension.

The degree of intrusion can be monitored electrically by mercury intrusion as the mercury retreats up the capillary by measuring the change in capacitance between the metal coat and the mercury column. Experience with mercury intrusion shows that the porosity is completely gone at a pressure of about 30,000 psi.

When the desired degree of intrusion has been reached, the oil bath is cooled below the melt temperature freezing the penetrant in place. The explosive sample is then removed and surface cleaned at which time it is ready for an application.

After the explosive has been filled with the heated pressurized pore filling material, the temperature is decreased to ambient temperature or other temperature below the melting point so that the pore filling material hardens or becomes substantially solid. This stabilized explosive having its larger pores substantially filled with hardened or solidified pore filling material will be relatively insensitive to accidental shock detonation.

In order to use the stabilized explosive, the explosive can be heated to a temperature which brings the pore filling material to a liquid or viscous state so that the material can be removed from the explosive. Alternatively, the stabilized explosive can be detonated, but this will require a greater shock wave pressure and temperature than the conventional explosive alone would require. In addition, if only a portion of the pore filling material is removed, detonation conditions will be determined by the amount of pore filling material left in the explosive.

The hazard to accidental shock initiation of explosive materials is greatly reduced by filling the pores with an inert material. Some of the most powerful chemical explosives (such as HMX) are limited in application by their sensitivity. By making them less sensitive without reducing their performance, the range of applicability of these more powerful explosives is expanded.

The stability of solid high explosives is enhanced whenever the sensitivity to shock initiation of high order reaction or detonation is reduced. The stability can be increased to progressively higher levels by filling smaller pores. By adjusting the stability or sensitivity of an explosive to be consistent with a particular application, safety during transport and storage can be increased. Furthermore, wider application of explosive devices in severe environments where the possibility of accidental explosion has until now excluded them, become possible.

Changes and modifications in the specifically described embodiments can be carried out without departing from the scope of the invention which is intended to be limited only by the scope of the appended claims.

I claim:

1. A method for suppressing the tendency of a porous solid high explosive to ignite and detonate, comprising:

filling substantially all the pres of the solid high explosive material with a predetermined pore radius of at least 10 μm with a relatively inert, stable, pore filling material in liquid form, the pore filling material being selected from gallium, rubidium-potassium eutectic, and Wood's metal; and solidifying the pore filling material in the pores of the explosive material.

2. The method of claim 1 wherein the step of filling the pores is performed by pressurizing the liquid pore filling material to a pressure sufficient to infiltrate substantially all the pores of at least the predetermined radius.

3. The method of claim 1 further comprising heating the pre filling material to a temperature above its melt temperature prior to filling the pores.

4. A method for suppressing the tendency of a porous solid high explosive to ignite and detonate, comprising:

filling substantially all the pores of the solid high explosive material of at least a predetermined pore radius with a relatively inert, stable, pore filling material in liquid form;

solidifying the pore filling material in the pores of the explosive material; and removing the pore filling material from the high explosive material prior to detonating the high explosive.

5. The method of claim 4 comprising removing the pore filling material by heating the explosive material filled with the pore filling material to a temperature above the melt temperature of the pore filling material to liquefy the pore filling material and removing the liquid pore filling material for the explosive material.

6. The method of claim 1 wherein the step of substantially filling the pores of a pore size is carried out so as to prevent shock initiated detonation above a predetermined shock pressure.

7. A stabilized solid high explosive comprising:

a porous solid high explosive material;

a relatively inert, solidified, stable pore filling material selected from gallium, rubidium-potassium eutectic and Wood's metal filling substantially all the pores of the explosive material of at least a predetermined pore radius.

8. The explosive of claim 7 wherein the pore filling material is substantially solidified or hardened in the pores at ambient temperature.

9. The explosive of claim 7 wherein the predetermined pore size is selected to prevent shock initiated detonation below a predetermined shock pressure.

10. The explosive of claim 7 wherein the pore filling material has a melt temperature in the range of about 30° C. to about 70° C.

11. The explosive of claim 7 wherein the explosive material is selected from PBX 9404, HMX, TATB, LX-17 and PETN.

12. The explosive of claim 7 wherein the predetermined pore radius is about 10 μm.

13. The method of claim 1 wherein the step of solidifying is performed by decreasing the temperature of the pore filling material to a lower ambient temperature where the pore filling material hardens and becomes substantially solid.

* * * * *